US011807411B2

(12) United States Patent
Garnier et al.

(10) Patent No.: US 11,807,411 B2
(45) Date of Patent: Nov. 7, 2023

(54) ARTICLE CARRIER AND BLANK THEREFOR

(71) Applicant: WestRock Packaging Systems, LLC, Atlanta, GA (US)

(72) Inventors: Jean-Michel Garnier, Issoudun (FR); Julien D. Merzeau, Châteauroux (FR)

(73) Assignee: WestRock Packaging Systems, LLC, Atlanta, GA (US)

( * ) Notice: Subject to any disclaimer, the term of this patent is extended or adjusted under 35 U.S.C. 154(b) by 154 days.

(21) Appl. No.: 17/608,190

(22) PCT Filed: Apr. 28, 2020

(86) PCT No.: PCT/US2020/070006
§ 371 (c)(1),
(2) Date: Nov. 2, 2021

(87) PCT Pub. No.: WO2020/227731
PCT Pub. Date: Nov. 12, 2020

(65) Prior Publication Data

US 2022/0212848 A1 Jul. 7, 2022

Related U.S. Application Data

(60) Provisional application No. 62/842,753, filed on May 3, 2019.

(51) Int. Cl.
*B65D 71/38* (2006.01)

(52) U.S. Cl.
CPC ..... *B65D 71/38* (2013.01); *B65D 2571/0079* (2013.01); *B65D 2571/00141* (2013.01);
(Continued)

(58) Field of Classification Search
CPC ..... B65D 71/38; B65D 2571/00141; B65D 2571/00462; B65D 2571/00524;
(Continued)

(56) References Cited

U.S. PATENT DOCUMENTS 2,274,253 A 2/1942 Howell
2,523,986 A 9/1950 Foster
(Continued)

FOREIGN PATENT DOCUMENTS

CA 3033378 A1 2/2018
DE 29909003 U1 9/1999
(Continued)

OTHER PUBLICATIONS

International Search Report and Written Opinion issued in corresponding International Patent Application No. PCT/US2020/070006 dated Sep. 1, 2020 (11 pages).

*Primary Examiner* — Andrew D Perreault
(74) *Attorney, Agent, or Firm* — Brian J. Goldberg; Rohini K. Garg

(57) ABSTRACT

Aspects of the disclosure relate to a carton for packaging one or more articles, and a blank for forming said carton. The carton comprising a plurality of primary panels 12*a*, 12*b*, 14, 16*a*, 16*b* at least partially extending around an interior of the carton, the plurality of primary panels comprising a top panel 14 and a pair of side panels 12*a*, 12*b*, 16*a*, 16*b* hingedly connected to opposed side edges of the top panel respectively, wherein the carrier further comprises an end closure structure 24*a*, 24*b* which partially closes an end of the carrier, the end closure structure comprises a top end closure panel 24*a*, 26*a* hingedly connected to an end edge of the top panel and at least one anchor panel 20*a*, 30*a* hingedly connected to an end edge of at least one of the pair of side panels.

15 Claims, 8 Drawing Sheets

(52) U.S. Cl.
CPC ..... *B65D 2571/00462* (2013.01); *B65D 2571/00524* (2013.01); *B65D 2571/00666* (2013.01); *B65D 2571/00728* (2013.01)

(58) Field of Classification Search
CPC ..... B65D 2571/00666; B65D 2571/00728; B65D 2571/0079; B65D 2571/00265
See application file for complete search history.

(56) References Cited

U.S. PATENT DOCUMENTS

| | | | |
|---|---|---|---|
| 3,330,463 | A | 7/1967 | Wood |
| 3,593,849 | A | 7/1971 | Helms et al. |
| 3,618,848 | A | 11/1971 | Pawlowski et al. |
| 3,765,529 | A | 10/1973 | Mueller |
| 3,819,035 | A | 6/1974 | Jaeschke |
| 4,641,746 | A | 2/1987 | Dornbusch et al. |
| 5,042,660 | A | 8/1991 | Carver |
| 5,480,091 | A | 1/1996 | Stout |
| 5,482,203 | A | 1/1996 | Stout |
| 5,647,483 | A | 7/1997 | Harris |
| 5,699,957 | A | 12/1997 | Blin et al. |
| 5,772,030 | A | 6/1998 | Baxter |
| 5,826,782 | A | 10/1998 | Stout |
| 5,996,883 | A | 12/1999 | Bates |
| 6,848,573 | B2 | 2/2005 | Gould et al. |
| 6,905,066 | B2 | 6/2005 | Holley, Jr. et al. |
| 6,971,572 | B2 | 12/2005 | Ikeda |
| 9,073,658 | B2 | 7/2015 | Spivey, Sr. et al. |
| 9,073,680 | B2 | 7/2015 | Kastanek |
| 9,718,246 | B2 | 8/2017 | Holley, Jr. et al. |

FOREIGN PATENT DOCUMENTS

| | | | |
|---|---|---|---|
| DE | 29913585 | U1 | 10/1999 |
| DE | 20206756 | U1 | 8/2002 |
| EP | 0428397 | B1 | 9/1996 |
| EP | 0754631 | A1 | 1/1997 |
| EP | 0813486 | B1 | 5/1999 |
| EP | 1381545 | A1 | 1/2004 |
| EP | 2055648 | A1 | 5/2009 |
| EP | 2310290 | B1 | 6/2012 |
| EP | 2207730 | B1 | 1/2013 |
| FR | 1394103 | A | 4/1965 |
| FR | 1512593 | A | 2/1968 |
| GB | 2234495 | A | 2/1991 |
| WO | 1985002385 | A1 | 6/1985 |
| WO | 2014052514 | A2 | 4/2014 |
| WO | 2016/133833 | A1 | 8/2016 |
| WO | 2018031391 | A1 | 2/2018 |

ARTICLE CARRIER AND BLANK THEREFOR

TECHNICAL FIELD

The present invention relates to product packaging, to article carriers or cartons, and to blanks for forming the same. More specifically, but not exclusively, the invention relates to a carrier having a carrying handle arranged transversely with respect to a tubular axis of an at least partially open-ended tubular structure. Aspect of the invention relate to an end retention structure for stabilising adjacently disposed articles within the article carrier.

BACKGROUND

In the field of packaging it is known to provide article carriers or cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

It is an object of the present disclosure to provide a carton or article carrier having a handle structure. It is desirable to provide the carton with an opening to display the articles disposed therein. It is desirable that the handle structure is sufficiently strong and robust when in use transporting the carton.

It is also desirable that the articles on display are securely held within the article carrier.

The present invention seeks to provide an improvement in the field of cartons and carton blanks, typically formed from paperboard or the like.

SUMMARY

An aspect of the disclosure provides a carton for packaging one or more articles. The carton comprises a plurality of primary panels at least partially extending around an interior of the carton. The plurality of primary panels comprises a top panel and a pair of side panels hingedly connected to opposed side edges of the top panel respectively. The carton further comprises an end closure structure which partially closes an end of the carton. The end closure structure comprises a top end closure panel hingedly connected to an end edge of the top panel and at least one anchor panel hingedly connected to an end edge of at least one of the pair of side panels. The at least one anchor panel is coupled to the top end closure panel by a gusset panel. The top end closure panel comprises at least one first article engaging tab for extending into a gap between two adjacent articles adjacent to the top end closure panel.

Advantageously, the top end closure panel may engage one or more articles adjacently disposed thereto so as to stabilise or support articles within the article carrier.

Optionally, the top end closure panel is obliquely oriented with respect to the top panel.

Optionally, the top end closure panel provides an overhanging face panel.

Optionally, the end closure structure comprises a first anchor panel hingedly connected to a first end edge of a first one of the pair of side panels, a second anchor panel hingedly connected to a first end edge of a second one of the pair of side panels. Each of the first and second anchor panels is coupled to the top end closure panel by a gusset panel respectively.

Optionally, the carton comprises a top end closure reinforcing panel hingedly connected to the top end closure panel, and wherein the top end closure reinforcing panel comprises at least one second article engaging tab in registry with said at least one first article engaging tab.

Optionally, the carton comprises an end closure structure partially closing each or both ends of the carton. A first end closure structure includes a first top end closure panel and partially closes a first end of the carton and a second end closure structure includes a second top end closure panel and partially closes a second end of the carton. The first and second top end closure panel each comprising at least one first article engaging tab for extending into a gap between two adjacent articles.

Optionally, the carton comprises a first top end closure reinforcing panel hingedly connected to the first top end closure panel, and wherein the first top end closure reinforcing panel comprises at least one second article engaging tab in registry with said at least one first article engaging tab of the first top end closure panel. The carton further comprises a second top end closure reinforcing panel hingedly connected to the first top end closure panel, and wherein the second top end closure reinforcing panel comprises at least one second article engaging tab in registry with said at least one first article engaging tab of the second top end closure panel.

Yet another aspect of the disclosure relates to a carton comprises a carrying handle including a handle feature defined in at least the top panel and a foldable handle structure having opposed connecting panels and a handle strap extending between the connecting panels. The handle structure being hingedly connected by first hinged connections, at the opposed connecting panels, to side panels of the carton along respective first edges thereof. The handle structure is folded into an interior of the carton such that the handle strap is disposed generally in vertical alignment with the handle feature. The carton comprises first and second opposed ends defined at least in part by opposed end edges of a top panel respectively. The first end of the carton is at least partially open and comprises an end opening extending at least between the first edges of the pair of side panels.

Optionally, at least one end of the carton is at least partially open and comprises an end opening extending at least between the end edges of the pair of side panels.

Optionally, the at least one anchor panel is hingedly connected to an end edge of said at least one of the pair of side panels by a second hinged connection, the second hinged connection being divergently arranged with respect to the first hinged connection.

Optionally, the top end closure panel is hingedly connected to said end edge of the top panel by a third hinged connection, the first hinged connection being offset from the third hinged connection.

Optionally, the first hinged connection is inset with respect to the third hinged connection.

This may be advantageous for reducing the material required to produce the carton thereby providing economic and environmental benefits.

Optionally, the plurality of panels comprises a base panel extending between the pair of side panels such that the plurality of primary panels provides a tubular structure defining a tubular axis.

Optionally, the first edges of the side panels are disposed transversely to the tubular axis.

Optionally, the carton is formed from at least first and second separate blanks, wherein one blank comprises a panel for forming the base panel, and wherein another blank comprises panels for forming the top panel and the pair of side panels.

Optionally, the end closure structure is a first end closure structure which partially closes a first end of the carton, and wherein the carton comprises a second end closure structure comprises a second top end closure panel hingedly connected to a second end edge of the top panel and at least one second anchor panel hingedly connected to a second end edge of at least one of the pair of side panels, said at least one second anchor panel being coupled to the second top end closure panel by a second gusset panel, wherein the second top end closure panel comprises at least one third article engaging tab for extending into a gap between two adjacent articles adjacent to the second top end closure panel.

Another aspect of the disclosure provides a blank for forming a carton. The blank comprising a plurality of primary panels for at least partially defining an interior of the carton. The plurality of primary panels comprises a top panel and a pair of side panels hingedly connected to opposed side edges of the top panel respectively. The blank further comprises an end closure structure for at least partially closing an end of the carton. The end closure structure comprises a top end closure panel hingedly connected to an end edge of the top panel and at least one anchor panel hingedly connected to an end edge of at least one of the pair of side panels. The at least one anchor panel is coupled to the top end closure panel by a gusset panel. The top end closure panel comprises at least one first article engaging tab for extending into a gap between two adjacent articles.

A further aspect of the disclosure provides a package comprising the combination of a carton and at least two articles. The carton comprises a plurality of primary panels at least partially extending around an interior of the carton. The plurality of primary panels comprises a top panel and a pair of side panels hingedly connected to opposed side edges of the top panel respectively. The carton further comprises an end closure structure which partially closes an end of the carton. The end closure structure comprises a top end closure panel hingedly connected to an end edge of the top panel and at least one anchor panel hingedly connected to an end edge of at least one of the pair of side panels. The at least one anchor panel is coupled to the top end closure panel by a gusset panel. The top end closure panel comprises at least one first article engaging tab extending into a gap between two adjacent articles.

Still another aspect of the disclosure provides a blank for forming a carton. The blank comprises a plurality of primary panels for at least partially defining an interior of the carton. The plurality of primary panels comprises a top panel and a pair of side panels hingedly connected to opposed side edges of the top panel respectively. The blank further comprises an end closure structure which partially closes an end of the carton. The end closure structure comprises a top end closure panel hingedly connected to an end edge of the top panel and at least one anchor panel hingedly connected to an end edge of at least one of the pair of side panels. The at least one anchor panel being coupled to the top end closure panel by a gusset panel. The top end closure panel comprises at least one first article engaging tab for extending into a gap between two adjacent articles.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the package, article carrier and blank are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the packages, article carriers and blanks described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
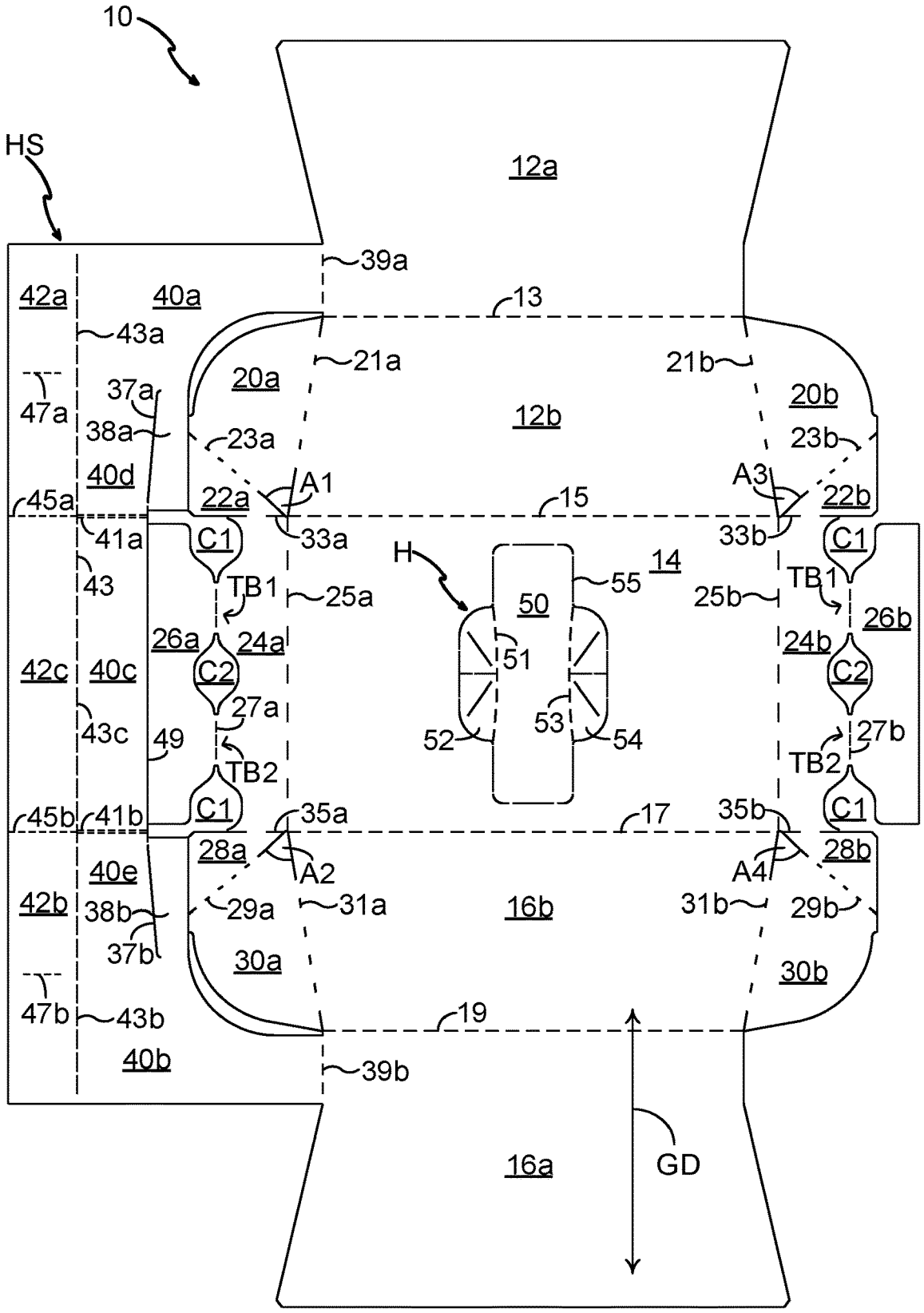
FIG. 1 is a plan view from above of a first blank for forming an article carrier according to a first embodiment.
Figure 5:
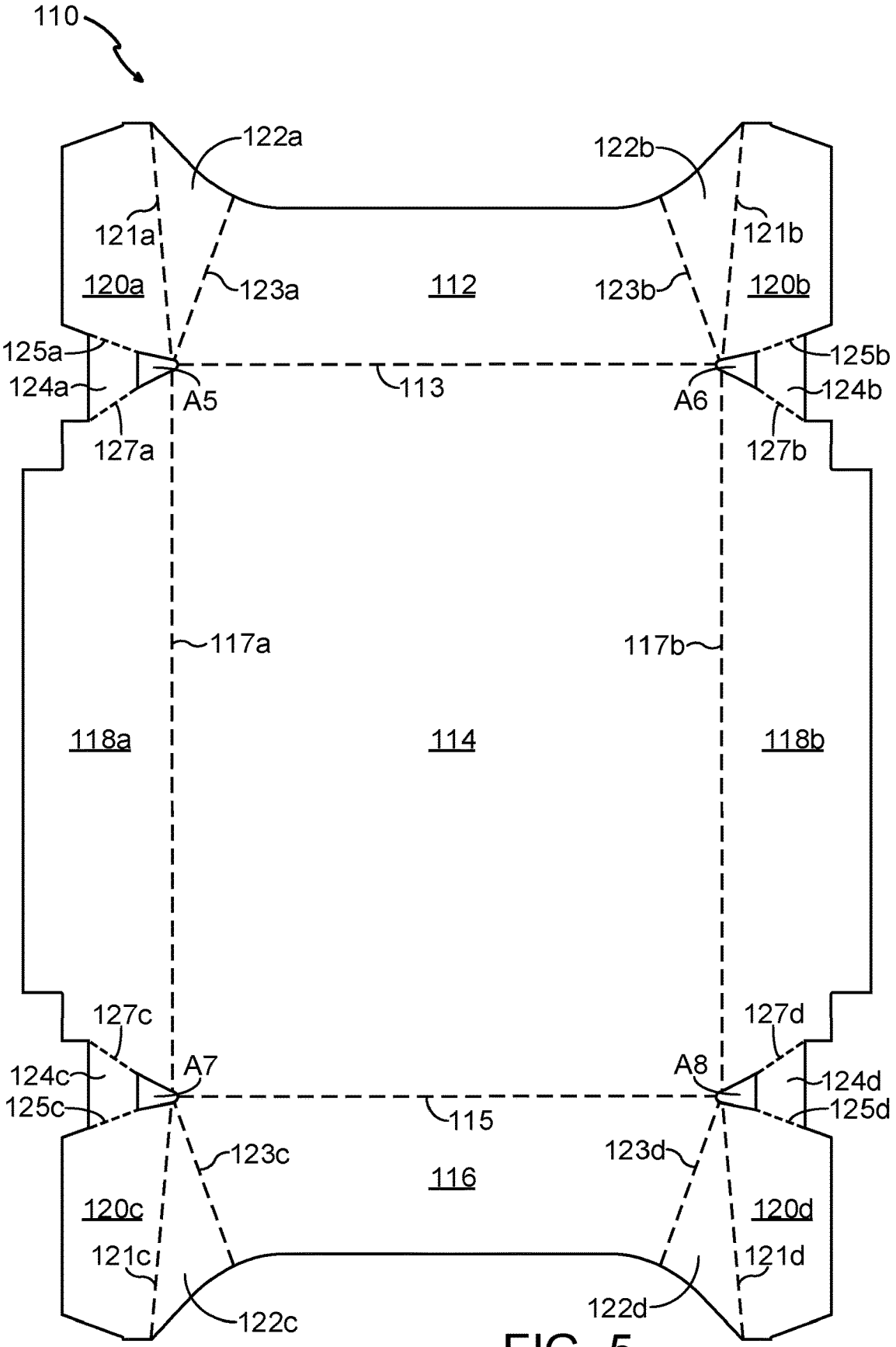
FIG. 5 is a plan view from above of a second blank for forming an article carrier according to a first embodiment.
Figure 6:
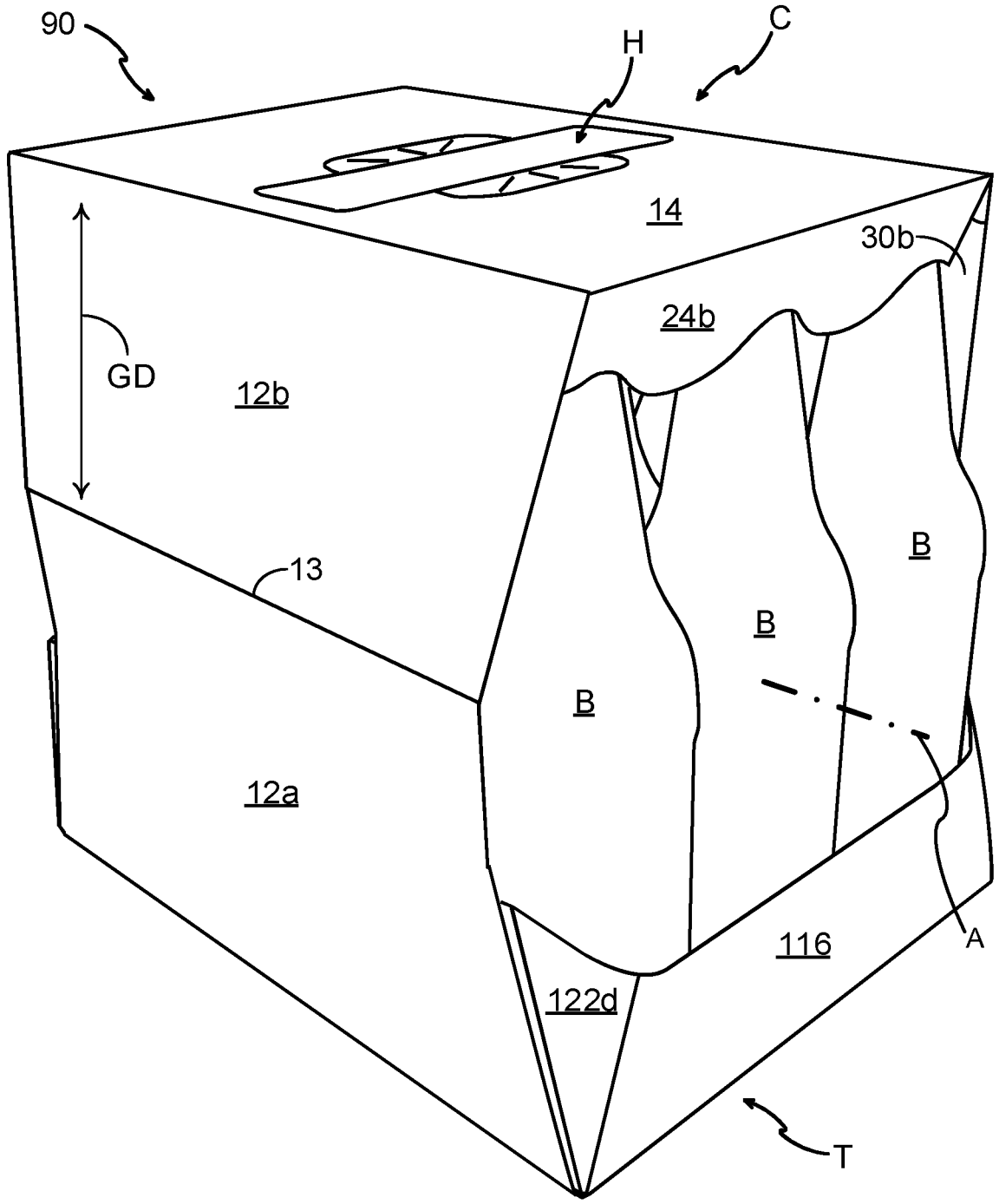
FIG. 6 is a perspective view of an article carrier formed from the blank of FIGS. 1 and 2.

Referring to FIGS. 1 and 5, there is shown plan views of a first blank 10 and a second blank 110 respectively, according to an embodiment of the disclosure, capable of forming a package in the form of an article carrier 90, as shown in FIG. 6, for containing and carrying a group of primary products such as, but not limited to, bottles, hereinafter referred to as articles B. The first blank 10 forms an upper portion C of the article carrier, also referred to herein as a top or cover, the second blank 110 forms a base or tray portion t.

Figure 8:
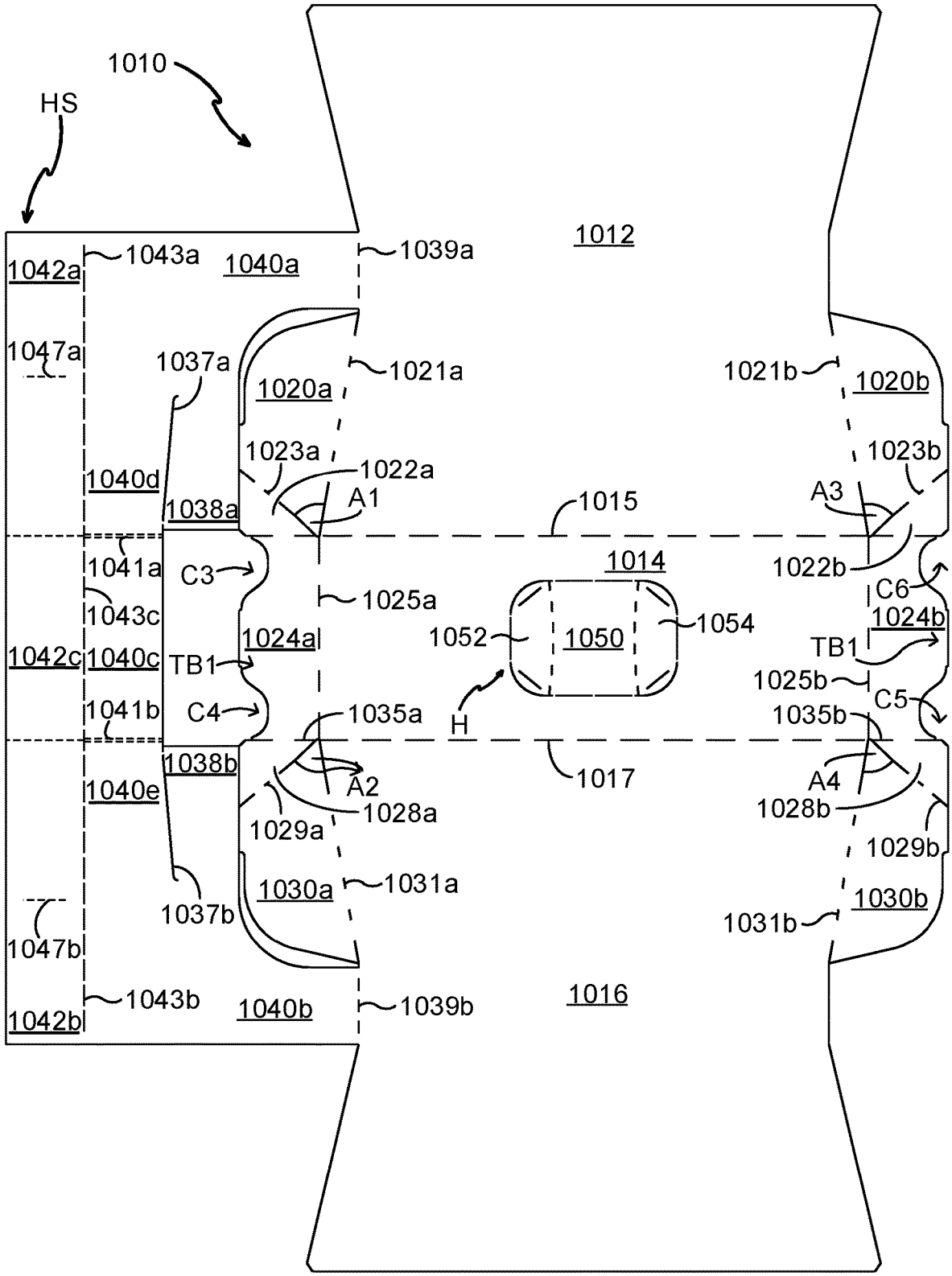
FIG. 8 is a plan view from above of a first blank for forming an article carrier according to a second embodiment.

Referring to FIG. 8, there is shown a plan views of a first blank 1010, according to another embodiment of the disclosure, capable of forming a package in the form of an article carrier (not shown) in combination with a tray portion similar to that formed by the blank of FIG. 5, for containing and carrying a group of primary products such as, but not limited to, bottles, hereinafter referred to as articles B. The first blank 1010 forms an upper portion of an article carrier (not shown).

In the embodiments detailed herein, the terms "carton" and "carrier" refer, for the non-limiting purpose of illustrating the various features of the invention, to a container 90 for engaging and carrying articles B, such as primary product containers B. It is contemplated that the teachings of the invention can be applied to various product containers B, which may or may not be tapered and/or cylindrical. Exemplary containers include, but not limited to, bottles (for example metallic, glass or plastics bottles), cans (for example aluminium cans), tins, pouches, packets and the like.

The blanks 10, 110; 1010 are formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The article carriers 90 described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

The tear resistant layer may be disposed over the uncoated side of the paperboard substrate and may be formed of polymeric material and secured to the substrate. The tear resistant layer imparts toughness to the laminate structure. Suitable tear resistant materials may include, but not be limited to, tear resistant laminated sheet material, e.g., NATRALOCK®, which may include a layer of an n-axially oriented film, e.g. MYLAR®, which is a bi-axially oriented polyester, oriented nylon, cross-laminated polyolefin or high density polyolefin. The orientation and cross-laminated structure of these materials contribute to the tear resistant characteristic. Also, tear resistance may be attributed to the chemical nature of the tear resistant material such as extruded metallocene-catalysed polyethylene (mPE).

Alternatively, the tear resistant layer may be a layer of linear low-density polyethylene (LLDPE). In embodiments where linear low-density polyethylene (LLDPE) or mPE is used, it is not necessary to incorporate an adhesive layer. Other suitable materials having a high level of tear resistance may also be used.

The adhesive layer may be formed of polyolefin material such as a low density polyethylene (LDPE). The adhesive layer may be placed between the substrate and the tear resistant layer to secure the tear resistant layer to the substrate.

In the embodiment illustrated in FIGS. 1 and 5, the first and second blanks 10, 110 are configured to form a carton or carrier 90 for packaging an exemplary arrangement of exemplary articles B. In the illustrated embodiment the arrangement is an m×n matrix or array, having three rows (m=3) and four columns (n=4); in the illustrated embodiment three rows of four articles B are provided, and the articles B are 500 ml bottles, the bottles may be formed from a suitable material such as, but not limited to, glass, Aluminium or PET (polyester-polyethylene terephthalate).

In the embodiment illustrated in FIG. 8, the first blank 1010 is configured to form a carton or carrier for packaging an exemplary arrangement of exemplary articles B. In the illustrated embodiment the arrangement is an m×n matrix or array, having two rows (m=2) and four columns (n=4); in the illustrated embodiment two rows of four articles B are provided, and the articles B are 500 ml bottles, the bottles may be formed from a suitable material such as, but not limited to, glass, Aluminium or PET (polyester-polyethylene terephthalate).

Alternatively, the blanks 10, 110; 1010 can be configured to form a carrier for packaging other types, number and size of articles B and/or for packaging articles B in a different arrangement or configuration for example, but not limited to, fully enclosed cartons or wrap-around carriers, the articles B may be cups, pouches, pots or cans.

Turning to FIG. 1, there is illustrated a first blank 10 for forming an article carrier 90 (see FIG. 6) according to a first embodiment.

The first blank 10 comprises a plurality of main panels 12*a*, 12*b*, 14, 16*a*, 16*b* for forming a top part or cover C. The plurality of main panels 12*a*, 12*b*, 14, 16*a*, 16*b* comprises a first lower side panel 12*a* (or lower outer side wall), a first upper side panel 12*b* (or upper outer side wall), a top panel 14, a second upper side panel 16*b* (or upper outer side wall) and a second lower side panel 16*a* (or lower outer side wall). The plurality of panels 12*a*, 12*b*, 14, 16*a*, 16*b* may be arranged in a linear series hinged one to the next by corresponding fold lines 13, 15, 17, 19.

The first blank 10 comprises an end closure structure for partially closing each end of the article carrier 90.

A first end closure structure comprises a first top end closure panel 24*a* hingedly connected to the top panel 14 by a hinged connection in the form of a fold line 25*a*. The first end closure structure comprises a first anchor panel 20*a* hingedly connected to a first edge of the first upper side panel 12*b* by a hinged connection in the form of a fold line 21*a*. The first top end closure panel 24*a* is coupled to the first anchor panel 20*a* by a first gusset panel 22*a*. The first gusset panel 22*a* is hingedly connected to the first top end closure panel 24*a* by a hinged connection in the form of a fold line 33*a*. The first gusset panel 22*a* is hingedly connected to the first anchor panel 20*a* by a hinged connection in the form of a fold line 23*a*. Optionally, the blank 10 comprises a first aperture A1 adjacent a first corner of the top panel 14. The first aperture A1 is struck from, or defined in, the first anchor panel 20*a*. The first aperture A1 may interrupt the fold lines 21*a*, 23*a*. The first aperture A1 may be substantially triangular in shape, the illustrated embodiment shows a first aperture A1 shaped as a sector of a circle having its centre at the intersection of fold lines 21*a*, 23*a*, wherein portion of the fold lines 21*a*, 23*a* define the radii of the sector.

The first end closure structure comprises a second anchor panel 30*a* hingedly connected to a first edge of the second upper side panel 16*b* by a hinged connection in the form of a fold line 31*a*. The first top end closure panel 24*a* is coupled to the second anchor panel 30*a* by a second gusset panel 28*a*. The second gusset panel 28*a* is hingedly connected to the first top end closure panel 24*a* by a hinged connection in the form of a fold line 35*a*. The second gusset panel 28*a* is hingedly connected to the second anchor panel 30*a* by a hinged connection in the form of a fold line 29*a*.

Optionally, the blank 10 comprises a second aperture A2 adjacent a second corner of the top panel 14. The second aperture A2 is struck from, or defined in, the second anchor panel 30*a*. The second aperture A2 may interrupt the fold lines 29*a*, 31*a*. The second aperture A2 may be substantially triangular in shape, the illustrated embodiment shows a second aperture A2 shaped as a sector of a circle having its centre at the intersection of fold lines 29*a*, 31*a*, wherein portion of the fold lines 29*a*, 31*a* define the radii of the sector.

Figure 3:
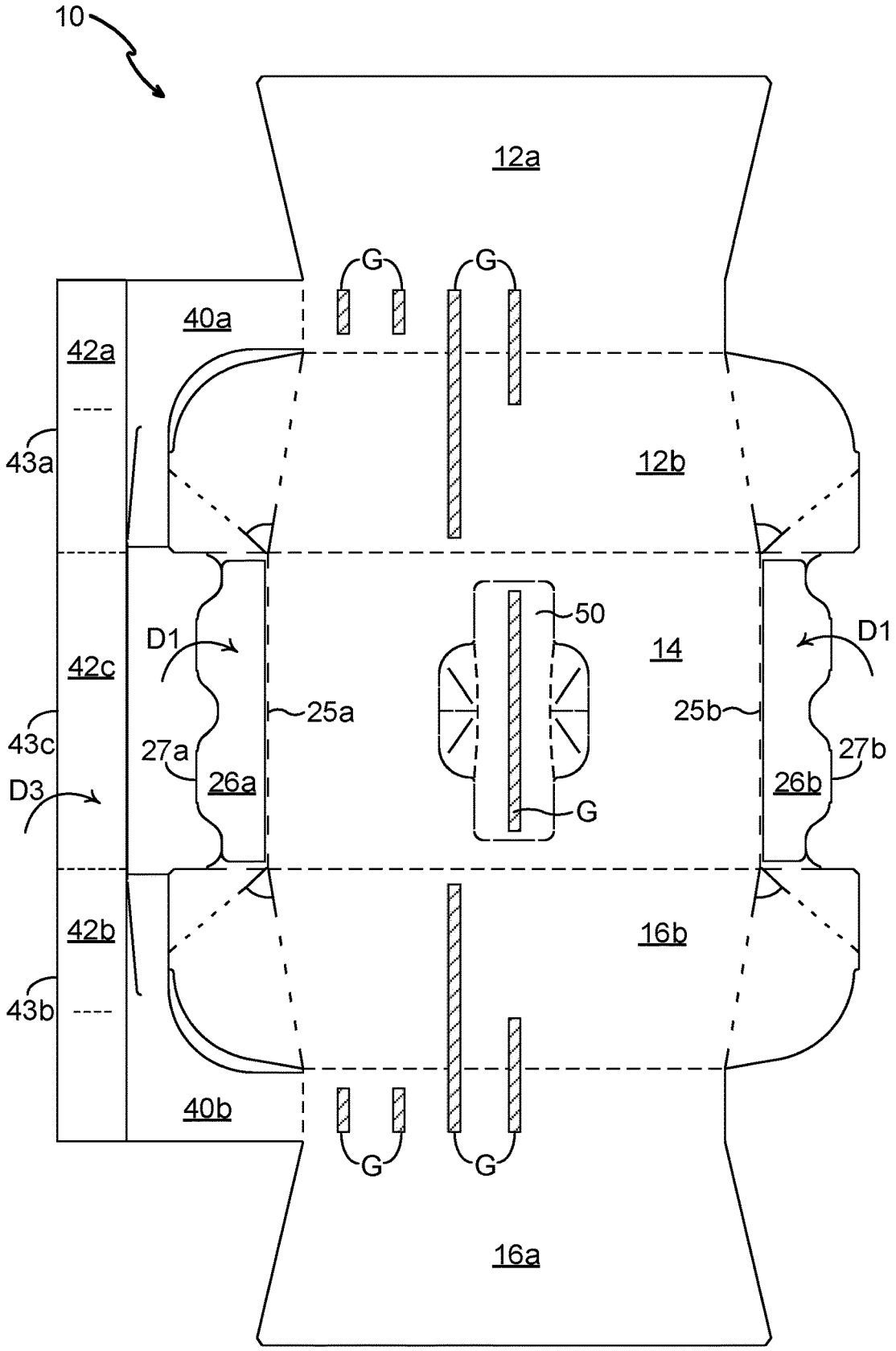

Optionally, the first end closure structure comprises a first inner top end closure panel 26*a* (also referred to herein as first top reinforcing end closure panel 26*a*) hingedly connected to the first top end closure panel 24*a* by a hinged connection in the form of a fold line 27*a*. The hinged connection may comprise or by interrupted by at least one cutaway C1, C2. The cutaways C1, C2 may be adapted to form a recessed or contoured edge along the first top end closure panel 24*a* and the first inner top end closure panel 26*a* when the first inner top end closure panel 26*a* is folded about fold line 27*a* into face contacting relationship with first top end closure panel 24*a* (as shown in FIG. 3).

A second end closure structure comprises a second top end closure panel 24*b* hingedly connected to the top panel 14 by a hinged connection in the form of a fold line 25*b*. The second end closure structure comprises a third anchor panel 20*b* hingedly connected to a second edge of the first upper side panel 12*b* by a hinged connection in the form of a fold line 21*b*. The second top end closure panel 24*b* is coupled to the third anchor panel 20*b* by a third gusset panel 22*b*. The third gusset panel 22*b* is hingedly connected to the second top end closure panel 24*b* by a hinged connection in the form of a fold line 33*b*. The third gusset panel 22*b* is hingedly connected to the third anchor panel 20*b* by a hinged connection in the form of a fold line 23*b*. Optionally, the blank 10 comprises a third aperture A3 adjacent a third corner of the top panel 14. The third aperture A3 is struck from, or defined in, the third anchor panel 20*b*. The third aperture A3 may interrupt the fold lines 21*b*, 23*b*. The third aperture A3 may be substantially triangular in shape, the illustrated embodiment shows a third aperture A3 shaped as a sector of a circle having its centre at the intersection of fold lines 21*b*, 23*b*, wherein portion of the fold lines 21*b*, 23*b* define the radii of the sector.

The second end closure structure comprises a fourth anchor panel 30*b* hingedly connected to a second edge of the second upper side panel 16*b* by a hinged connection in the form of a fold line 31*b*. The second top end closure panel 24*b* is coupled to the fourth anchor panel 30*b* by a fourth gusset panel 28*b*. The fourth gusset panel 28*b* is hingedly connected to the second top end closure panel 24*b* by a hinged connection in the form of a fold line 35*b*. The fourth gusset panel 28*b* is hingedly connected to the fourth anchor panel 30*b* by a hinged connection in the form of a fold line 29*b*.

Optionally, the blank 10 comprises a fourth aperture A4 adjacent a fourth corner of the top panel 14. The fourth aperture A4 is struck from, or defined in, the fourth anchor panel 30*b*. The fourth aperture A4 may interrupt the fold lines 29*b*, 31*b*. The fourth aperture A4 may be substantially triangular in shape, the illustrated embodiment shows a fourth aperture A4 shaped as a sector of a circle having its centre at the intersection of fold lines 29*b*, 31*b*, wherein portion of the fold lines 29*b*, 31*b* define the radii of the sector.

Optionally, the first end closure structure comprises a second inner top end closure panel 26*b* (also referred to herein as second top reinforcing end closure panel 26*b*) hingedly connected to the second top end closure panel 24*b* by a hinged connection in the form of a fold line 27*b*. The hinged connection may comprise or by interrupted by at least one cutaway C1, C2. The cutaways C1, C2 may be adapted to form a recessed or contoured edge along the second top end closure panel 24*b* and the second inner top end closure panel 26*b* when the second inner top end closure panel 26*b* is folded about fold line 27*b* into face contacting relationship with second top end closure panel 24*b* (as shown in FIG. 3).

The cutaways C1, C2 at least partially define an article engaging tab TB1, TB2 therebetween. The illustrated embodiment comprises two article engaging tabs TB1, TB2, in other embodiments more or fewer article engaging tabs TB1, TB2 may be provided.

It will be understood that the article engaging tabs TB1, TB2 may be provided by projections or extensions of the first and second top end closure panels 24*a*, 24*b* in alternative embodiments.

The first blank 10 comprises a carrying handle structure HS. The carrying handle structure HS comprises a handle strap 40*c*/40*d*/40*e* hingedly connected to a side edge of the plurality of main panels 12*a*, 12*b*, 14, 16*a*, 16*b* and a handle opening defined in the top panel 14, optionally the handle opening is defined by a handle panel or feature H struck, at least, from the top panel 14 and defined by a cutline or severable line 55. The handle panel H may comprise a grip panel 50, which is optionally rectangular or bow-tie shaped. The handle panel H may comprise a cushioning flap 52, 54 hinged to opposing side edges of the grip panel 50 by a hinged connection in the form of fold lines 53, 54 respectively. Each cushioning flap 52, 54 may comprise at least one fold line for facilitating folding of the cushioning flaps 52, 54. Each cushioning flap 52, 54 may comprise a cutline or severance line for facilitating division of the cushioning flaps 52, 52 into two parts each hinged to their respective side edge of the grip panel 50.

The handle strap 40*c*/40*d*/40*e* comprises a central portion 40*c*; a first end of the central portion 40*c* is hinged to, or integral with a first connecting panel 40*a* and a second end of the central portion 40*c* is hinged to, or integral with a second connecting panel 40*b*.

The first connecting panel 40*a* is hinged to a first side edge of the first lower side panel 12*a* by a hinged connection in the form of a fold line 39*a*. The second connecting panel 40*b* is hinged to a first side edge of the second lower side panel 16*a* by a hinged connection in the form of a fold line 39*b*.

The central portion 40*c* of the handle strap 40*c*/40*d*/40*e* may be hinged to a first end portion 40*d* of the handle strap 40*c*/40*d*/40*e* by a hinged connection in the form of a fold line or pair of fold lines 41*a*. The first end portion 40*d* is formed from, or struck from, the first connecting panel 40*a*. The first end portion 40*d* is defined in part by a cut line or severable line 37*a* defined in the first connecting panel 40*a*. A first securing portion 38*a* of the first connecting panel 40*a* is disposed adjacent to the cut line or severable line 37*a*.

The central portion 40*c* of the handle strap 40*c*/40*d*/40*e* may be hinged to a second end portion 40*e* of the handle strap 40*c*/40*d*/40*e* by a hinged connection in the form of a fold line or pair of fold lines 41*b*. The second end portion 40*e* is formed from, or struck from, the second connecting panel 40*b*. The second end portion 40*e* is defined in part by a cut line or severable line 37*b* defined in the second connecting panel 40*b*. A second securing portion 38*b* of the second connecting panel 40*b* is disposed adjacent to the cut line or severable line 37*b*.

The cut lines 37*a*, 37*b* may terminate in a 'J' or 'C' shaped cutline.

The grain direction GD of the substrate forming the carton is shown in FIG. 1 and in FIG. 6, the grain direction GD extends transversely with respect to a tubular axis A of the tubular structure or such that the grain direction extends from a top edge, defined by fold lines 15, 17 of the upper side panels 12*b*, 16*b* to a bottom edge of the lower side panels 12*a*, 16*a* of the blank 10; the bottom edge opposes the top edge.

Grain direction GD refers to the general alignment of fibres of the substrate, the fibres of the substrate are generally aligned parallel to the direction arrow indicating the grain direction GD.

The carrying handle is arranged so as to extend transversely of the tubular axis A of the tubular structure. The handle structure HS is arranged such that the grain direction GD of the substrate extends longitudinally, between the end portions 40*d*, 40*e*, along the handle strap 40*c*/40*d*/40*e*.

The first inner top end closure panel 26*a* is separated from, or separable from, the central portion 40*c* of the handle strap 40*c*/40*d*/40*e* by a cut or severance line 49.

Optionally, the handle structure HS comprises a reinforcing strap 42*a*/42*b*/42*c*, the reinforcing strap 42*a*/42*b*/42*c* is hingedly connected to the handle strap 40*c*/40*d*/40*e* by a hinged connection in the form of a fold line 43. The reinforcing strap 42*a*/42*b*/42*c* comprises a central reinforcing portion 42*c* hingedly connected to the central portion 40*c* of the handle strap 40*c*/40*d*/40*e* by a hinged connection in the form of a fold line 43*c*. The reinforcing strap 42*a*/42*b*/42*c* comprises a first and second end reinforcing portions 42*a*, 42*b* hingedly connected to the respective one of the first and second end portions 40*d*, 40*e* of the handle strap 40*c*/40*d*/40*e* by hinged connections in the form of a fold line 43*a*, 43*b*.

The first and second end reinforcing portions 42*a*, 42*b* of the reinforcing strap 42*a*/42*b*/42*c* are hingedly connected to the respective one of the first and second end portions 40*d*, 40*e* of the handle strap 40*c*/40*d*/40*e* by hinged connections in the form of a fold line 45*a*, 45*b*.

The first and second end reinforcing portions 42*a*, 42*b* of the reinforcing strap 42*a*/42*b*/42*c* may each comprise a fold line 47*a*, 47*b* spaced apart and substantially parallel to a respective one of the fold lines 45*a*, 45*b*. The fold line 47*a*, 47*b* may define upper and lower regions of first and second end reinforcing portions 42*a*, 42*b*.

In a setup condition the lower regions of the first and second end reinforcing portions 42*a*, 42*b* may be adapted to be secured by adhesive or other means to the first or second side wall 12*a*/12*b*, 16*a*/16*b*. The upper regions of the first and second end reinforcing portions 42*a*, 42*b* and the central reinforcing portion 42*c* may be unsecured or free from the first or second side wall 12*a*/12*b*, 16*a*/16*b* and top panel 16 respectively.

The fold lines 21*a*, 31*a* are disposed between the fold lines 39*a*, 39*b*. The fold line 21*a* is disposed contiguous with the fold line 39*a*. The fold line 21*a* is disposed divergently with the fold line 39*a*. The fold line 31*a* is disposed contiguous with the fold line 39*b*. The fold line 31*a* is disposed divergently with the fold line 39*b*.

The fold lines 39*a*, 39*b* are offset with respect to the fold line 25*a*. The fold lines 39*a*, 39*b* are inset with respect to the fold line 25*a*.

The fold line 21*a* is disposed divergently with the fold line 25*a*. The fold line 31*a* is disposed divergently with the fold line 25*a*. The fold line 21*a* and the fold line 25*a* define an acute angle therebetween. The fold line 31*a* and the fold line 25*a* define an acute angle therebetween.

The width of the first and second anchor panels 20*a*, 30*a* increases towards a lower end thereof, this may increase the extent to which the first and second anchor panels 20*a*, 30*a* extend into the carton 90 in a setup condition, which may in turn increase the degree of engagement of the first and second anchor panels 20*a*, 30*a* with an adjacently disposed article B.

The fold lines 39*a*, 39*b* may be arranged to provide less folding resistance than the fold lines 21*a*, 31*a*, that is to say they may be more easily folded.

The fold line 21*b* is disposed divergently with the fold line 25*b*. The fold line 31*b* is disposed divergently with the fold line 25*b*. The fold line 21*b* and the fold line 25*a* define an acute angle therebetween. The fold line 31*b* and the fold line 25*b* define an acute angle therebetween.

The width of the third and fourth anchor panels 20*b*, 30*b* increases towards a lower end thereof, this may increase the extent to which the third and fourth anchor panels 20*b*, 30*b* extend into the carton 90 in a setup condition, which may in turn increase the degree of engagement of the third and fourth anchor panels 20*b*, 30*b* with an adjacently disposed article B.

In the blank 10 the first end closure structure is disposed between the plurality of main panels 12*a*, 12*b*, 14, 16*a*, 16*b* and the panels providing the carrying handle structure HS. The first end closure structure is surrounded by the plurality of main panels 12*a*, 12*b*, 14, 16*a*, 16*b* and the panels providing the carrying handle structure HS. The first end closure structure is separated, or separable, from the panels providing the carrying handle structure HS. In the illustrated embodiments a combination of cut lines and cutaways or apertures separate the first end closure structure from the panels providing the carrying handle structure HS. The first anchor panel 20*a* may be separated, at least in part, from the first connecting panel 40*a* by a crescent shaped aperture. The second anchor panel 30*a* may be separated, at least in part, from the second connecting panel 40*b* by a crescent shaped aperture.

The second blank 110 comprises a plurality of panels 112, 114, 116, 118*a*, 118*b* for forming a base or tray T. The plurality of main panels 112, 114, 116, 118*a*, 118*b* comprises a base panel 114, a first lower end closure flap 112, a second lower end closure flap 116, a first side flap 118*a* (or inner side wall) and a second side flap 118*b* (or inner side wall).

The first lower end closure flap 112 is hingedly connected to a first end edge of the base panel 114 by a hinged connection in the form of a fold line 113. The second lower end closure flap 116 is hingedly connected to a second, opposing end edge of the base panel 114 by a hinged connection in the form of a fold line 115. The first side flap

118*a* is hingedly connected to a first side edge of the base panel 114 by a hinged connection in the form of a fold line 117*a*, the first side edge is disposed adjacent to the first and second end edges. The second side flap 118*b* is hingedly connected to a second side edge of the base panel 114 by a hinged connection in the form of a fold line 117*b*, the second side edge is disposed opposite to the first side edge and adjacent to the first and second end edges.

A first side securing panel 120*a* is coupled to at least one of the first lower end closure flap 112 and the first side flap 118*a* by a hinged connection, either directly by a fold line or indirectly by virtue of a hinged connection to an interconnecting panel 122*a*, 124*a*. The first side securing panel 120*a* facilitates securing the first lower end closure flap 112 to the first side flap 118*a* so as to form upstanding walls from the base panel 114.

The first lower end closure flap 112 may be coupled to the first side flap 118*a*. An optional first corner panel 122*a* may be hingedly connected to a first edge of the first lower end closure flap 112 by a hinged connection in the form of a fold line 123*a*. The first side securing panel 120*a* may be hingedly connected to the first corner panel 122*a* by a hinged connection in the form of a fold line 121*a*. In other embodiments the first side securing panel 120*a* may be hingedly connected to the first lower end closure flap 112.

A first web panel 124*a* may be hingedly connected to the first side securing panel 120*a* by a hinged connection in the form of a fold line 125*a*. The first web panel 124*a* may be hingedly connected to the first side flap 118*a* by a hinged connection in the form of a fold line 127*a*. In some embodiments, the first side securing panel 120*a* may be hingedly connected to the first side flap 118*a*.

A cutaway in the form of a fifth aperture A5 separates the first web panel 124*a* from the base panel 114. The fifth aperture A5 intersects or terminates the fold line 113, fold line 121*a*, fold line 123*a*, fold line 125*a*, fold line 127*a* and the fold line 117*a*.

A second side securing panel 120*b* is coupled to at least one of the first lower end closure flap 112 and the second side flap 118*b* by a hinged connection, either directly by a fold line or indirectly by virtue of a hinged connection to an interconnecting panel 122*b*, 124*b*. The second side securing panel 120*b* facilitates securing the first lower end closure flap 112 to the second side flap 118*b* so as to form upstanding walls from the base panel 114.

The first lower end closure flap 112 may be coupled to the second side flap 118*b*. An optional second corner panel 122*b* may be hingedly connected to a second edge of the first lower end closure flap 112 by a hinged connection in the form of a fold line 123*b*. The second side securing panel 120*b* may be hingedly connected to the second corner panel 122*b* by a hinged connection in the form of a fold line 121*b*. In other embodiments the second side securing panel 120*b* may be hingedly connected to the first lower end closure flap 112.

A second web panel 124*b* may be hingedly connected to the second side securing panel 120*b* by a hinged connection in the form of a fold line 125*b*. The second web panel 124*b* may be hingedly connected to the second side flap 118*b* by a hinged connection in the form of a fold line 127*b*. In some embodiments, the second side securing panel 120*b* may be hingedly connected to the second side flap 118*b*.

A cutaway in the form of a sixth aperture A6 separates the second web panel 124*b* from the base panel 114. The sixth aperture A6 intersects or terminates the fold line 113, fold line 121*b*, fold line 123*b*, fold line 125*b*, fold line 127*b* and the fold line 117*b*.

A third side securing panel 120*c* is coupled to at least one of the second lower end closure flap 116 and the first side flap 118*a* by a hinged connection, either directly by a fold line or indirectly by virtue of a hinged connection to an interconnecting panel 122*c*, 124*c*. The third side securing panel 120*c* facilitates securing the second lower end closure flap 116 to the first side flap 118*a* so as to form upstanding walls from the base panel 114.

The second lower end closure flap 116 may be coupled to the first side flap 118*a*. An optional third corner panel 122*c* may be hingedly connected to a first edge of the second lower end closure flap 116 by a hinged connection in the form of a fold line 123*c*. The third side securing panel 120*c* may be hingedly connected to the third corner panel 122*c* by a hinged connection in the form of a fold line 123*a*. In other embodiments the third side securing panel 120*c* may be hingedly connected to the second lower end closure flap 116.

A third web panel 124*c* may be hingedly connected to the third side securing panel 120*c* by a hinged connection in the form of a fold line 125*c*. The third web panel 124*c* may be hingedly connected to the first side flap 118*a* by a hinged connection in the form of a fold line 125*c*. In some embodiments, the third side securing panel 120*c* may be hingedly connected to the first side flap 118*a*.

A cutaway in the form of a seventh aperture A7 separates the third web panel 124*c* from the base panel 114. The seventh aperture A7 intersects or terminates the fold line 115, fold line 121*c*, fold line 123*c*, fold line 125*c*, fold line 127*c* and the fold line 117*a*.

A fourth side securing panel 120*d* is coupled to at least one of the second lower end closure flap 116 and the second side flap 118*b* by a hinged connection, either directly by a fold line or indirectly by virtue of a hinged connection to an interconnecting panel 122*d*, 124*d*. The fourth side securing panel 120*d* facilitates securing the second lower end closure flap 116 to the second side flap 118*b* so as to form upstanding walls from the base panel 114.

The second lower end closure flap 116 may be coupled to the second side flap 118*b*. An optional fourth corner panel 122*d* may be hingedly connected to a second edge of the second lower end closure flap 116 by a hinged connection in the form of a fold line 123*d*. The fourth side securing panel 120*d* may be hingedly connected to the fourth corner panel 122*d* by a hinged connection in the form of a fold line 121*d*. In other embodiments the fourth side securing panel 120*d* may be hingedly connected to the second lower end closure flap 116.

A fourth web panel 124*d* may be hingedly connected to the fourth side securing panel 120*d* by a hinged connection in the form of a fold line 125*d*. The fourth web panel 124*d* may be hingedly connected to the second side flap 118*b* by a hinged connection in the form of a fold line 127*d*. In some embodiments, the fourth side securing panel 120*d* may be hingedly connected to the second side flap 118*b*.

A cutaway in the form of an eighth aperture A8 separates the fourth web panel 124*d* from the base panel 114. The eighth aperture A8 intersects or terminates the fold line 115, fold line 121*d*, fold line 123*d*, fold line 125*d*, fold line 127*d* and the fold line 117*b*.

Turning to the construction of the package as illustrated in FIG. 6, the article carrier 90 can be formed by a series of sequential folding operations. The folding process is not limited to that described below and may be altered according to particular manufacturing requirements.

The second blank 110 is constructed into a tray or lower portion T of an article carrier 90.

Glue or other adhesive treatment is applied to each of the first, second, third and fourth side securing panels 120*a*, 120*b*, 120*c*, 120*d*. In other embodiments the glue may be applied to a corresponding regions of an inner surface of the first and second side flaps 118*a*, 118*b*.

The second blank 110 is folded about fold line 113 and fold line 115 such that the first lower end closure flap 112 and the second lower end closure flap 116 are brought into substantially perpendicular relationship with respect to the base panel 114. In response, the first and second side flaps 118*a*, 118*b* are simultaneously folded about fold line 117*a*, 117*b* respectively. The first, second, third and fourth side securing panels 120*a*, 120*b*, 120*c*, 120*d* are folded so as to be disposed in face contacting relationship with a respective one of the first and second side flaps 118*a*, 118*b*. In doing so the first and second corner panels 122*a*, 122*b*, 122*c*, 122*d* are folded so as to extend between one of the first and second lower end closure flaps 112, 116 and an adjacent one of the first and second side flaps 118*a*, 118*b*. In this way a tray T is formed with an open upper end.

Figure 2:
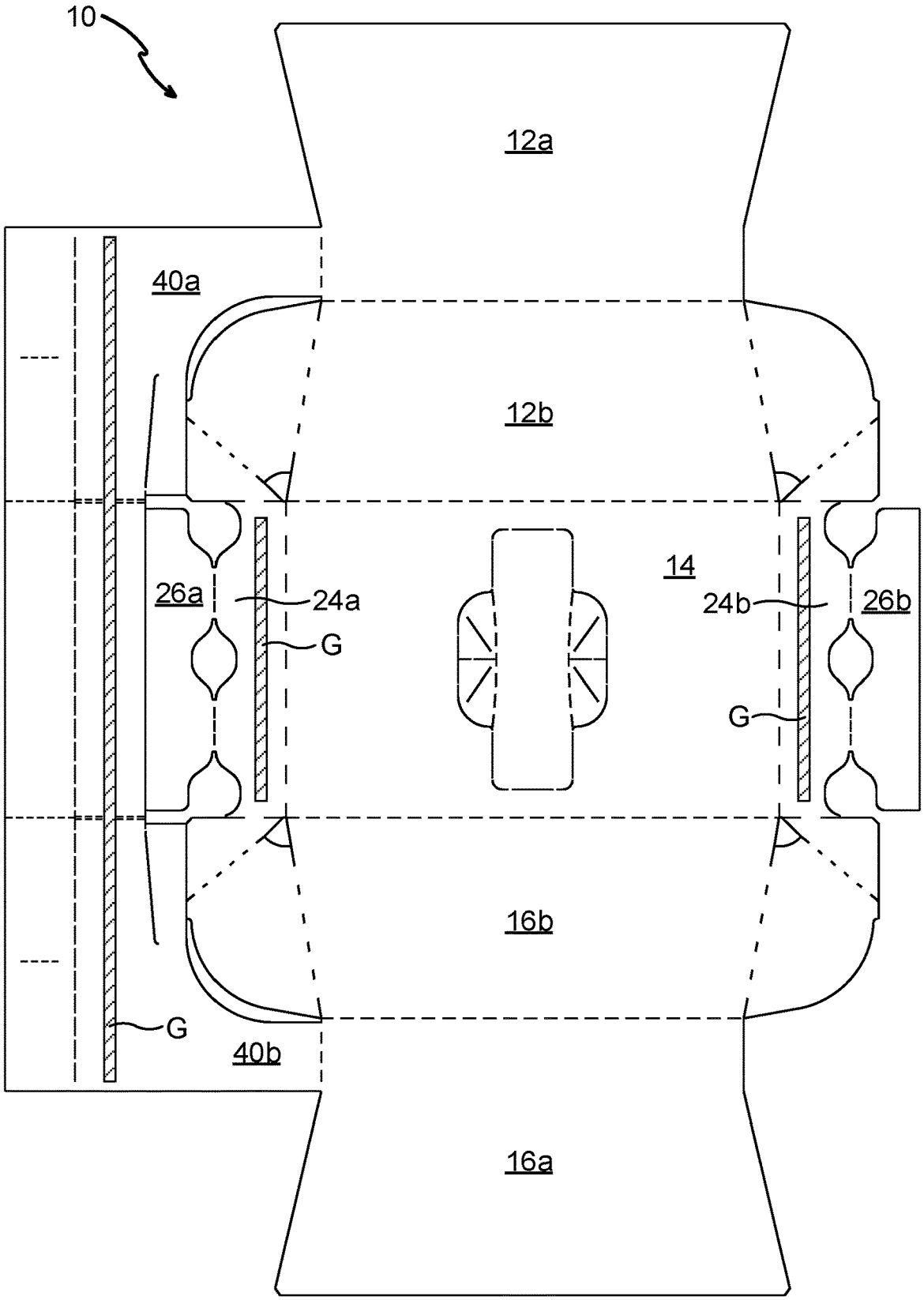
FIGS. 2 to 4 illustrate stages of construction of an article carrier from the blank of FIG. 1.

Referring now to FIG. 2, glue G or other adhesive treatment is applied to the handle strap 40*c*/40*d*/40*e*, glue G is applied to the central portion 40*c* and to each of the first and second end portions 40*d*, 40*e*; glue is applied to the first and second connecting panels 40*a*, 40*b*. The reinforcing strap 42*a*/42*b*/42*c* is then placed into face contacting relationship with the handle strap 40*c*/40*d*/40*eb* folding the reinforcing strap 42*a*/42*b*/42*c* about fold lines 43*a*, 43*b*, 43*c* as indicated by direction arrow D3 in FIG. 3. The reinforcing strap 42*a*/42*b*/42*c* is secured to the handle strap 40*c*/40*d*/40*e*. The reinforcing strap 42*a*/42*b*/42*c* may be formed from paperboard or a plastics material.

Glue G or other adhesive treatment is applied to the first and second top reinforcing end closure panels 26*a*, 26*b*, as shown in FIG. 2.

Figure 4:
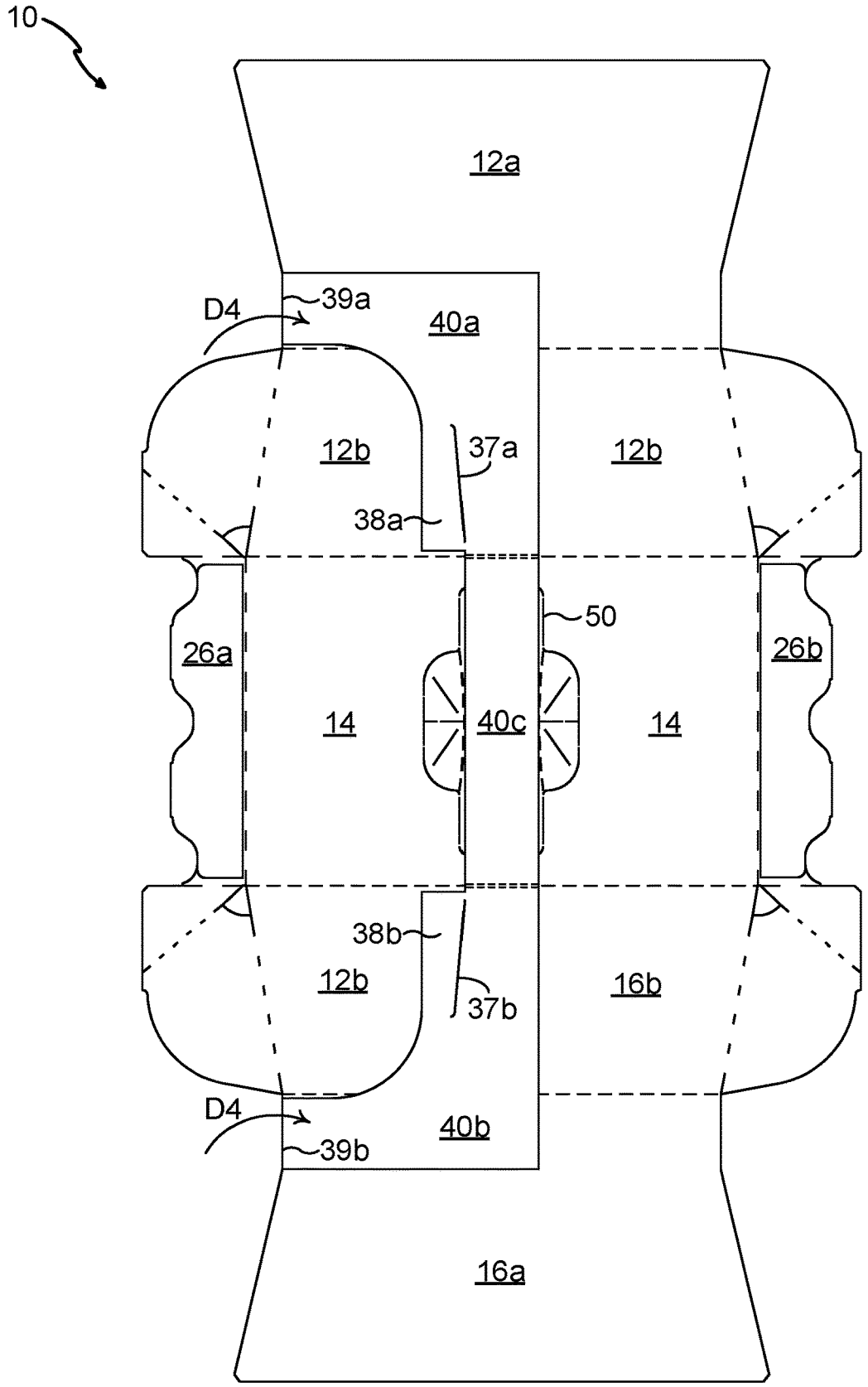

The first blank 10 is folded about fold lines 27*a*, 27*b*, as indicated by direction arrows D1 in FIG. 4, such that the first and second top reinforcing end closure panels 26*a*, 26*b* overlies the respective one of the first and second top end closure panels 24*a*, 24*b*. The first top reinforcing end closure panel 26*a* is secured to the first top end closure panel 24*a*. The second top reinforcing end closure panel 26*b* is secured to the second top end closure panel 24*b*.

Glue G or other adhesive treatment is applied to the first lower side panel 12*a*, the first upper side panel 12*b*, the second upper side panel 16*b* and the second lower side panel 16*a*, as shown in FIG. 3. Alternatively, glue G or other adhesive treatment is applied to outer end portions of the first and second end reinforcing portions 42*a*, 42*b* of the reinforcing strap 42*a*/42*b*/42*c* and to the first and second connecting panels 40*a*, 40*b*.

Portions of the first and second end reinforcing portions 42*a*, 42*b* of the reinforcing strap 42*a*/42*b*/42*c* adjacent to the central portion 42 of the reinforcing strap 42*a*/42*b*/42*c* are free from glue or adhesive.

The first blank 10 is folded about fold lines 39*a*, 39*b*, as indicated by direction arrows D4 in FIG. 4, such that the first connecting panel 40*a* overlies the first side panel 12*a*/12*b* and the second connecting panel 40*b* overlies the second side panel 16*a*/16*b*. The first connecting panel 40*a* is disposed in face contacting relationship with each of the first lower side panel 12*a* and the first upper side panel 12*b*. The first connecting panel 40*a* is secured to each of the first lower side panel 12*a* and the first upper side panel 12*b*. The second connecting panel 40*b* is disposed in face contacting relationship with each of the second upper side panel 16*b* and the second lower side panel 16*a*. The second connecting panel 40*b* is secured to each of the second upper side panel 16*b* and the second lower side panel 16*a*. The central portion 42 of the reinforcing strap 42*a*/42*b*/42*c* is secured to the grip panel 50 of the handle panel H.

The tray T (see FIG. 6) is loaded with a group of articles B.

Glue or other adhesive treatment is applied to the first side flap 118*a* and to the second side flap 118*b*, in alternative embodiments the glue may be applied to corresponding regions of the inner surface of the first and second lower side panels 12*a*, 16*a* of the first blank 10.

The first blank 10 of FIG. 4 is folded about an upper end of the group of articles B. The first and second side panels 12*a*/12*b*, 16*a*/16*b* are folded with respect to the top panel 14 about fold lines 15, 17 respectively.

The first, second, third and fourth anchor panels 20*a*, 30*a*, 20*b*, 30*b* are folded into face contacting relationship with the respective one of the first and second upper side panels 12*b*, 16*b* to which they are hinged. In response the first and second top end closure panels 24*a*, 24*b* (and the first and second top reinforcing end closure panels 26*a*, 26*b* when present) are automatically folded about their respective hinged connections 25*a*, 25*b* to the top panel 14.

The first and second lower side panels 12*a*, 16*a* are disposed in face contacting relationship with the first and second side flaps 118*a*, 118*b* respectively. The first lower side panel 12*a* is secured to the first side flap 118*a*. The second lower side panel 16*a* is secured to the second side flap 118*b*. The first and second side panels 12*a*/12*b*, 16*a*/16*b* form outer side walls of the article carrier 90. The first and second side flaps 118*a*, 118*b* form inner side walls of the article carrier 90. The side walls 12*a*/12*b*/118*a*, 16*a*/16*b*/118*b* of the article carrier 90 are composite in structure; the side walls 12*a*/12*b*/118*a*, 16*a*/16*b*/118*b* comprise an inner layer 118*a*, 118*b* and an outer layer 12*a*/12*b*, 16*a*/16*b*.

FIG. 6 shows an assembled article carrier 90. The article carrier 90 comprises a tubular structure defined in part by the tray T and in part by the top part or cover C. The tubular structure comprises a tubular axis A, the first and second side panels 12*a*/12*b*, 16*a*/16*b* are disposed transversely to the tubular axis A.

The tubular structure comprises first and second ends, the first end is partially closed by the first lower end closure flap 112 and the first top end closure panel 24*a*, the second end is partially closed by the second lower end closure flap 116 and the second top end closure panel 24*b*.

Each of first and second ends comprises a display or viewing window through which portion of the articles B are visible. The endmost articles B adjacent the display window may be oriented in a predefined direction such that a desired aspect or face of the articles B is adjacent the display window and is prominently displayed.

The first top end closure panel 24*a* and second top end closure panel 24*b* may be disposed obliquely to the top panel 14.

An inner surface of each of the first top end closure panel 24*a* and second top end closure panel 24*b* may define an acute angle with respect to an inner surface of the top panel 14. In this way the first top end closure panel 24*a* and second top end closure panel 24*b* may provide an overhanging face. The lower edges of the first top end closure panel 24*a* and second top end closure panel 24*b* being disposed in closer proximity to each other than the upper edges of the first top end closure panel 24*a* and second top end closure panel 24*b*.

The first top end closure panel 24*a* and second top end closure panel 24*b* are inclined with respect the top panel 14 and the bottom panel 114. The angle of inclination may be characterised, at least in part, by the angles defined between fold lines 21*a*, 21*b*, 31*a*, 31*b* and the adjacent one of fold lines 15, 17.

Figure 7A:
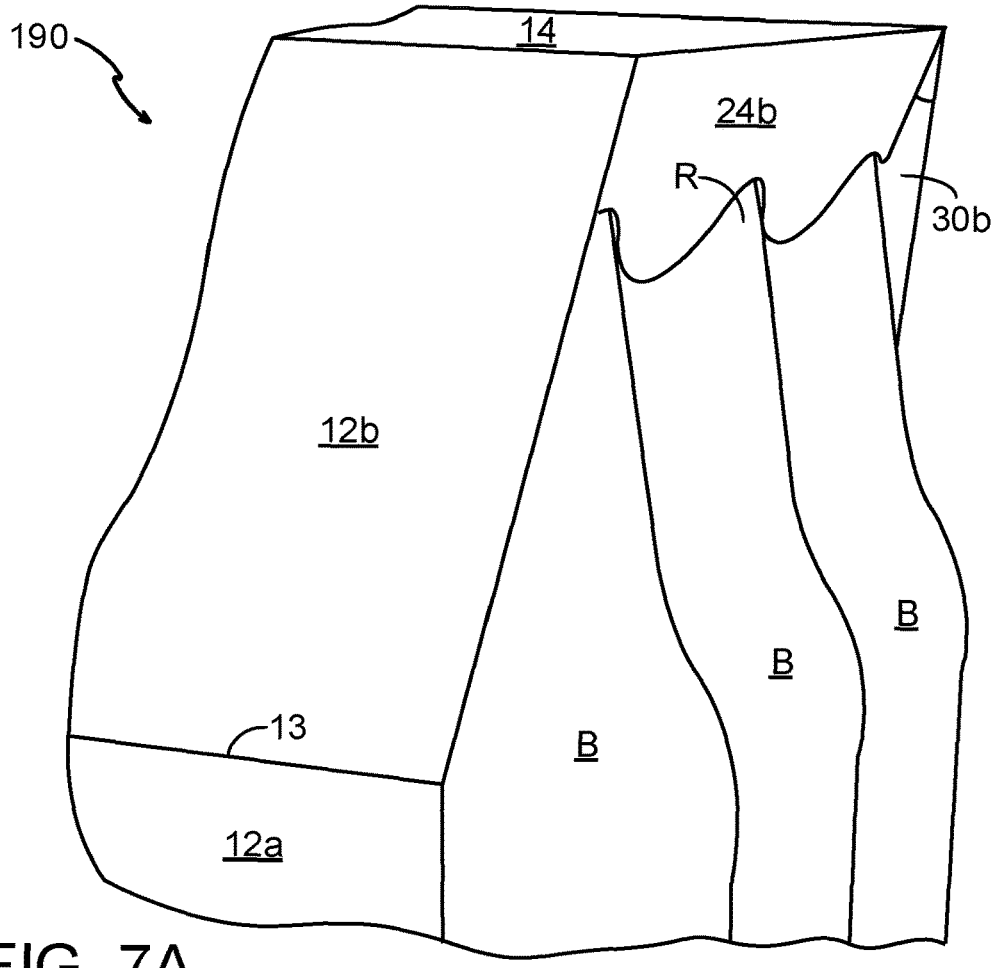
FIGS. 7A and 7*b* are alternative perspective views of a portion of the article carrier of FIG. 6.
Figure 7B:
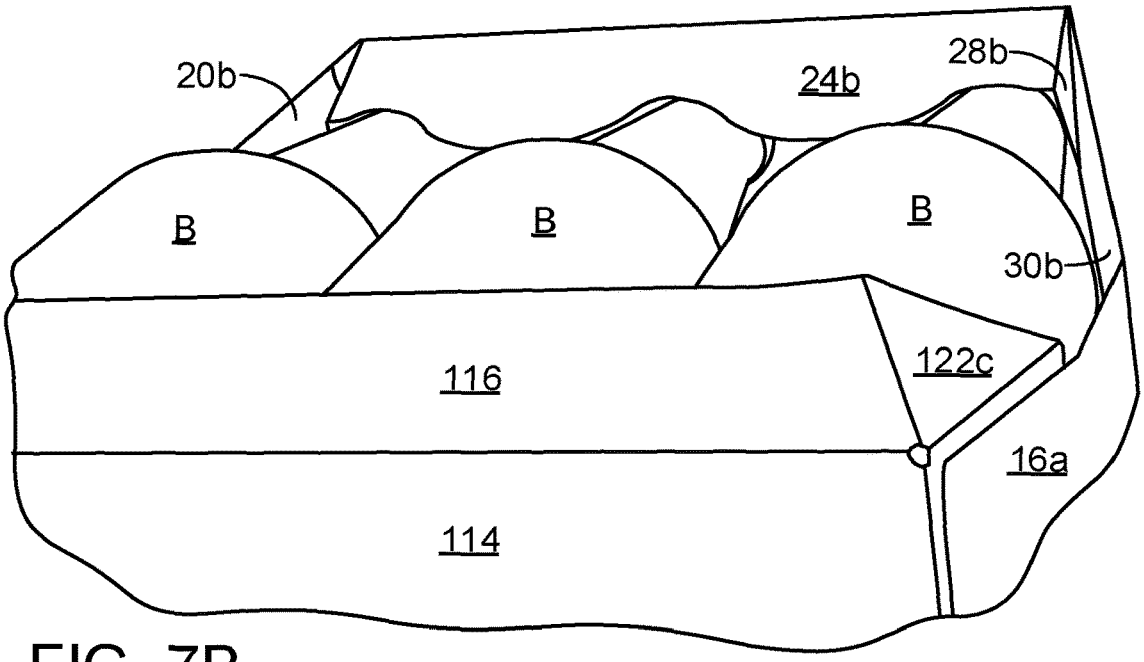

The recessed or contoured edges of the first and second top end closure panels 24*a*, 24*b* may be arranged to accommodate adjacent portions of the articles B in the article carrier 90. A portion of an article B may be received in each recess in the lower edge of the first and second top end closure panels 24*a*, 24*b*, best illustrated in FIGS. 7A and 7B.

Each of the tabs TB1, TB2 extends into a void, gap or recess between a pair of articles B.

The contoured shape of the free edge of the first and second top end closure panels 24*a*, 24*b* may reduce or inhibit movement of the articles B when in the article carrier 90. The arrangement may be particularly advantageous to reduce or inhibit lateral or transverse movement. The transverse direction extending perpendicular (between the first and second side panels 12*a*/12*b*, 16*a*/16*b*) to the tubular axis A.

Each of the anchor panels 20*a*, 20*b*, 20*c*, 20*d* is disposed between one of the first and second side panels 12*a*/12*b*, 16*a*/16*b* and an adjacent article B. Together with the gusset panels 22*a*, 22*b*, 22*c*, 22*d* the anchor panels 20*a*, 20*b*, 20*c*, 20*d* secure the first and second top end closure panels 24*a*, 24*b* in position partially closing the ends of the carrier 90.

Referring now to FIG. 8 there is shown an alternative embodiment of the present disclosure. In the second illustrated embodiment, like numerals have, where possible, been used to denote like parts, albeit with the addition of the prefixes "200" to indicate that these features belong to the second embodiment. The second embodiment shares many common features with the embodiment of FIGS. 1 to 7B, therefore only the differences from the embodiment illustrated in FIGS. 1 to 7B will be described in any greater detail.

FIG. 8 shows a first blank 1010 for forming an article carrier 290 according to a second embodiment.

The first blank 1010 comprises a plurality of main panels 1012, 1014, 1016 for forming a top part or cover. The plurality of main panels 1012, 1014, 1016 comprises a first side panel 1012 (or outer side wall), a top panel 1014, a second side panel 1016 (or outer side wall). The plurality of panels 1012, 1014, 1016 may be arranged in a linear series hinged one to the next by corresponding fold lines 1015, 1017. The fold lines 13, 19 of the first embodiment shown in FIG. 1 have been omitted.

Similar to the first embodiment the first and second side panels 1012, 1016 may be bow tie shaped. That is to say upper and lower tapered portions extend from a medial portion. The medial portion is substantially rectangular in shape. Opposed ends of the medial portion are arranged to be substantially perpendicular to the hinged connection between first and second side panels 1012, 1016 and the top panel 1014. The upper and lower portions of the first and second side panels 1012, 1016 each comprise opposed ends which are divergently arranged with respect to each other.

The medial portion of the first and second side panels 1012, 1016 is shorter in length along a longitudinal direction of the carton than the top panel 1014. The longitudinal direction is parallel to the tubular axis of the carton.

The fold lines 1021*a*, 1021*b*, 1031*a*, 1031*b*, hinging the anchor panels 1020*a*, 1020*b*, 1020*c*, 1020*d* to the respective one of the first and second side panels 1012, 1016 are obliquely oriented with respect to the fold lines 1015, 1017.

In the embodiment of FIG. 8 the first and second inner top end closure panels 1026*a*, 1026*b* have been omitted. A free edge of the first and second top end closure panels 1024*a*, 1024*b* opposing the hinged connection 1025*a*, 1025*b* to the top panel 1014 is recessed or contoured; cutaways C3, C4, C5, C6 are struck from the free edges of the first and second top end closure panels 1024*a*, 1024*b*. The embodiment of FIG. 8 comprises two recesses defined in the lower, free edge of each of the first and second top end closure panels 1024*a*, 1024*b*.

The cutaways C3, C4; C5, C6 at least partially define an article engaging tab TB1 therebetween. In the illustrated embodiment each of the first and second top end closure panels 1024*a*, 1024*b* comprises one article engaging tab TB1, in other embodiments more article engaging tabs TB1 may be provided.

It will be understood that the article engaging tab TB1 may be provided by a projection or extension of the first and second top end closure panels 1024*a*, 1024*b* in alternative embodiments.

The present disclosure provides a package comprising a carton or article carrier 90 loaded with one or more articles B. The carton 90 comprises a plurality of main or primary panels at least partially extending around an interior of the carton 90. The plurality of primary panels comprises a top panel 114; 1014 and a pair of side panels 12*a*/12*b*, 16*a*/16*b*; 1012, 1016 hingedly connected to opposed side edges of the top panel 114; 1014 respectively.

The carton 90 may comprise a carrying handle including a handle feature H defined in at least the top panel 114; 1014 and a foldable handle structure HS having opposed connecting panels 40*a*, 40*b*; 1040*a*, 1040*b* and a handle strap 40*c*/40*d*/40*e*; 1040*c*/1040*d*/1040*e* extending between the connecting panels 40*a*, 40*b*; 1040*a*, 1040*b*. The handle structure HS is hingedly connected at the opposed connecting panels 40*a*, 40*b*; 1040*a*, 1040*b* thereof to the side panels 12*a*/12*b*, 16*a*/16*b*; 1012, 1016 along respective first edges (defined by fold lines 39*a*, 39*b*; 1039*a*, 1039*b*) of the side panels 12*a*/12*b*, 16*a*/16*b*; 1012, 1016 such that the handle structure is foldable or folded into the interior of the carton. In the assembled condition the handle strap 40*c*/40*d*/40*e*; 1040*c*/1040*d*/1040*e* is disposed generally in vertical alignment with the handle feature H. The carton 90 comprises first and second opposed ends defined at least in part by opposed end edges of the top panel respectively.

The first end of the carton 90 may be at least partially open and may comprise an end opening extending at least between the first edges of the side panels.

The first end of the carton 90 comprises an end closing structure 20*a*/24*a*/30*a*, 20*b*/24*b*/30*b*; 1020*a*/1024*a*/1030*a*, 1020*b*/1024*b*/1030*b* which partially closes an end of the carton 90. The end closing structure comprises anchor panels 20*a*, 30*a*, 20*b*, 30*b*; 1020*a*, 1030*a*, 1020*b*, 1030*b* hingedly connected to the end edges of the side panels 12*a*/12*b*, 16*a*/16*b*; 1012, 1016 respectively.

The end closing structure comprises a top end closure panel 24*a*, 24*b*; 1024*a*, 1024*b* hingedly connected to an end edge of the top panel 14; 1014 respectively.

The top end closure panel 24*a*, 24*b*; 1024*a*, 1024*b* is coupled to an anchor panel 20*a*, 30*a*, 20*b*, 30*b*; 1020*a*, 1030*a*, 1020*b*, 1030*b* by a gusset panel 22*a*, 22*b*, 22*c*, 22*d*; 1022*a*, 1022*b*, 1022*c*, 1022*d*.

The top end closure panel 24*a*, 24*b*; 1024*a*, 1024*b* comprises at least one first article receiving recess C1, C2, C3, C4, C5, C6.

The carton 90 comprises a top end closure reinforcing panel 26*a*, 26*b*; 1026*a*, 1026*b* hingedly connected to the top end closure panel 24*a*, 24*b*; 1024*a*, 1024*b*, and wherein the top end closure reinforcing panel 26*a*, 26*b*; 1026*a*, 1026*b* comprises at least one second article receiving recess C1, C2 in registry with said at least one first article receiving recess C1, C2, C3, C4, C5, C6.

The carton 90 comprises a top end closure panel 24*a*, 24*b*; 1024*a*, hingedly connected to the top panel 14; 1014, having at least one first article engaging tab TB1, TB2 extending from an edge of the a top end closure panel 24*a*, 24*b*; 1024*a* opposing the hinged connection to the top panel 14; 1014.

The carton 90 comprises a top end closure reinforcing panel 26*a*, 26*b*; 1026*a*, 1026*b* at least one second article engaging tab in registry with the at least one first article engaging tab TB1, TB2 of the top end closure panel 24*a*, 24*b*; 1024*a*.

The handle strap 40*c*/40*d*/40*e*; 1040*c*/1040*d*/1040*e* may comprise opposed end portions 40*c*, 40*e*; 1040*c*, 1040*e* and an intermediate portion 40*d*; 1040*d* extending between the opposed end portions 40*c*, 40*e*; 1040*c*, 1040*e*. The opposed end portions 40*c*, 40*e*; 1040*c*, 1040*e* may be formed at least partially from the connecting panels 40*a*, 40*b*; 1040*a*, 1040*b* respectively.

The plurality of panels may comprise a base panel 114 extending between the side panels 12*a*/12*b*, 16*a*/16*b*; 1012, 1016 such that the plurality of primary panels provides a tubular structure defining a tubular axis A. The first edges of the side panels are disposed transversely to the tubular axis A.

The carton 90 may be formed from at least first and second separate blanks 10, 110; 1010, wherein one blank 110 comprises a panel 114 for forming the base panel 114, and wherein another blank 10; 1010 comprises panels for forming the top panel 14; 1014, the side panels 12*a*/12*b*, 16*a*/16*b*; 1012, 1016 and the handle structure HS.

Another embodiment of the disclosure provides a package comprising the combination of a carton 90 and at least two articles B. The carton 90 comprises a plurality of primary panels at least partially extending around an interior of the carton. The plurality of primary panels comprises a top panel 114; 1014 and a pair of side panels 12*a*/12*b*, 16*a*/16*b*; 1012, 1016 hingedly connected to opposed side edges of the top panel 114; 1014 respectively. The carton further comprises an end closing structure 20*a*/24*a*/30*a*, 20*b*/24*b*/30*b*; 1020*a*/1024*a*/1030*a*, 1020*b*/1024*b*/1030*b* which partially closes an end of the carton 90. The end closure structure comprises a top end closure panel 24*a*, 24*b*; 1024*a*, 1024*b* hingedly connected to an end edge of the top panel 14; 1014 and at least one anchor panel 20*a*, 30*a*, 20*b*, 30*b*; 1020*a*, 1030*a*, 1020*b*, 1030*b* hingedly connected to an end edge of at least one of the pair of side panels 12*a*/12*b*, 16*a*/16*b*; 1012, 1016. The at least one anchor panel 20*a*, 30*a*, 20*b*, 30*b*; 1020*a*, 1030*a*, 1020*b*, 1030*b* is coupled to the top end closure panel 24*a*, 24*b*; 1024*a*, 1024*b* by a gusset panel 22*a*, 22*b*, 22*c*, 22*d*; 1022*a*, 1022*b*, 1022*c*, 1022*d*. The top end closure panel 24*a*, 24*b*; 1024*a*, 1024*b* comprises at least one first article engaging tab TB1, TB2 extending into a gap G between two adjacent articles B.

The anchor panels 20*a*, 30*a*, 20*b*, 30*b*; 1020*a*, 1030*a*, 1020*b*, 1030*b* and a gusset panels 22*a*, 22*b*, 22*c*, 22*d*; 1022*a*, 1022*b*, 1022*c*, 1022*d* secure or hold the top end closure panel 24*a*, 24*b*; 1024*a*, 1024*b* in an operative condition or engaging position with the articles B.

It will be appreciated that the present disclosure provides a blank comprising a handle structure hinged along a first edge of a plurality of main panels forming at part of a tubular structure of a carton. The handle structure comprises a series of panels; a first one of the series of panels is hinged to a first panel of the plurality of main panels and a second one of the series of panels is hinged to a second panel the plurality of main panels. The second panel opposes the first panel in a setup condition. The blank comprises at least one end closure panel hinged along the first edge of the plurality of main panels and being disposed between plurality of main panels providing the tubular structure and the series of panels providing the handle structure. The at least one end closure panel is separated from the series of panels providing the handle structure by a cutaway in the form of an aperture, slot, slit, cut line, severable line or any combination thereof.

It can be appreciated that various changes may be made within the scope of the present invention. For example, the size and shape of the panels may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A carton for packaging one or more articles, the carton comprising a plurality of primary panels at least partially extending around an interior of the carton, the plurality of primary panels comprising a top panel and a pair of side panels hingedly connected to opposed side edges of the top panel respectively, wherein the carton further comprises an end closure structure which partially closes an end of the carton, the end closure structure comprises a top end closure panel hingedly connected to an end edge of the top panel and at least one anchor panel hingedly connected to an end edge of at least one of the pair of side panels, said at least one anchor panel being coupled to the top end closure panel by a gusset panel, wherein the top end closure panel comprises at least one first article engaging tab for extending into a gap between two adjacent articles adjacent to the top end closure panel.

2. A carton according to claim 1 wherein the top end closure panel is obliquely oriented with respect to the top panel.

3. A carton according to claim 1 wherein the top end closure panel provides an overhanging face panel.

4. A carton according to claim 1 comprising a top end closure reinforcing panel hingedly connected to the top end closure panel, and wherein the top end closure reinforcing panel comprises at least one second article engaging tab in registry with said at least one first article engaging tab.

5. A carton according to claim 1 comprising a carrying handle including a handle feature defined in at least the top panel and a foldable handle structure having opposed connecting panels and a handle strap extending between the connecting panels, the handle structure being hingedly connected, by first hinged connections, at the opposed connecting panels thereof to the pair of side panels along respective first edges of the pair of side panels, the handle structure is folded into the interior of the carton such that the handle strap is disposed generally in vertical alignment with the handle feature, wherein the carton comprises first and second opposed ends defined at least in part by opposed end edges of the top panel respectively, and wherein the first end of the carton is at least partially open and comprises an end opening extending at least between the first edges of the pair of side panels.

6. A carton according to claim 1 wherein at least one end of the carton is at least partially open and comprises an end opening extending at least between the end edges of the pair of side panels.

7. A carton according to claim 5 wherein the at least one anchor panel is hingedly connected to an end edge of said at least one of the pair of side panels by a second hinged connection, the second hinged connection being divergently arranged with respect to the first hinged connection.

8. A carton according to claim 5 wherein the top end closure panel is hingedly connected to said end edge of the top panel by a third hinged connection, the first hinged connection being offset from the third hinged connection.

9. A carton according to claim 8 wherein the first hinged connection is inset with respect to the third hinged connection.

10. A carton according to claim 1 wherein the plurality of panels comprise a base panel extending between the pair of side panels such that the plurality of primary panels provides a tubular structure defining a tubular axis.

11. A carton according to claim 5 wherein the first edges of the side panels are disposed transversely to the tubular axis.

12. A carton according to claim 1 wherein the carton is formed from at least first and second separate blanks, wherein one blank comprises a panel for forming the base panel, and wherein another blank comprises panels for forming the top panel and the pair of side panels.

13. A carton according to claim 1 wherein the end closure structure is a first end closure structure which partially closes a first end of the carton, and wherein the carton comprises a second end closure structure comprises a second top end closure panel hingedly connected to a second end edge of the top panel and at least one second anchor panel hingedly connected to a second end edge of at least one of the pair of side panels, said at least one second anchor panel being coupled to the second top end closure panel by a second gusset panel, wherein the second top end closure panel comprises at least one third article engaging tab for extending into a gap between two adjacent articles.

14. A carton according to claim 1 wherein the top end closure panel further comprises at least one first article receiving recess for engaging an article adjacent to the top end closure panel, the at least one first article receiving recess being disposed next to the at least one first article engaging tab.

15. A blank for forming a carton, the blank comprising a plurality of primary panels for at least partially defining an interior of the carton, the plurality of primary panels comprising a top panel and a pair of side panels hingedly connected to opposed side edges of the top panel respectively, wherein the blank further comprises an end closure structure which partially closes an end of the carton, the end closure structure comprises a top end closure panel hingedly connected to an end edge of the top panel and at least one anchor panel hingedly connected to an end edge of at least one of the pair of side panels, said at least one anchor panel being coupled to the top end closure panel by a gusset panel, wherein the top end closure panel comprises at least one first article engaging tab for extending into a gap between two adjacent articles.

* * * * *